United States Patent [19]

Toya

[11] Patent Number: 4,732,340

[45] Date of Patent: Mar. 22, 1988

[54] ARTICLE HOLDER

[75] Inventor: Takeshi Toya, Tokyo, Japan

[73] Assignee: Texas Instruments Incorporated, Dallas, Tex.

[21] Appl. No.: 940,881

[22] Filed: Dec. 10, 1986

[51] Int. Cl.[4] ..... B65H 16/06

[52] U.S. Cl. ..... 242/55.2; 16/225; 16/280; 16/385; 16/DIG. 13

[58] Field of Search ..... 242/55.2, 68.4, 129.51, 242/129.53; 225/46, 47; 16/DIG. 13, 225, 227, 280, 385; 211/16, 44, 70; 248/DIG. 9

[56] References Cited

U.S. PATENT DOCUMENTS 3,629,901 12/1971 Wolf ..... 16/227
4,381,083 4/1983 Tsunetsugu ..... 242/55.2

FOREIGN PATENT DOCUMENTS 791907 8/1968 Canada ..... 16/225
104453 10/1966 Denmark ..... 16/225

*Primary Examiner*—John M. Jillions
*Attorney, Agent, or Firm*—Richard A. Bachand; Melvin Sharp; N. Rhys Merrett

[57] ABSTRACT

An article holder characterizd by a unitary construction forming a living hinge structure provided by integral sheet portions and sections coupled together across hinge lines to provide ease of mounting an article on and removing the article from the holder and to permit significant reduction in the number of the component members and elements and accordingly the production cost of the article holder. Such an article holder comprises comprising a base section hingedly connected to the bracket portion, a flap section hingedly connected to the base section across split first hinge lines which extend laterally of the unitary member, an intermediate joint section intervening between the base section and flap section and having a portion extending into the base section and a portion extending into the flap section, the joint section being defined by a second hinge line intervening between the base and joint sections, a third hinge line intervening between the flap and joint sections, and a pair of cut lines extending between the second and third hinge lines. The split first hinge lines are aligned with each other across the intermediate joint section and the second and third hinge lines extend in parallel with the first hinge lines. A generally cylindrical spool portion axially extends from one side face of the flap section for engagement with the article to be supported by the holder.

7 Claims, 12 Drawing Figures

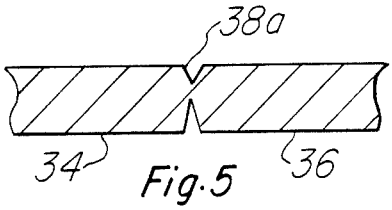
Fig.5
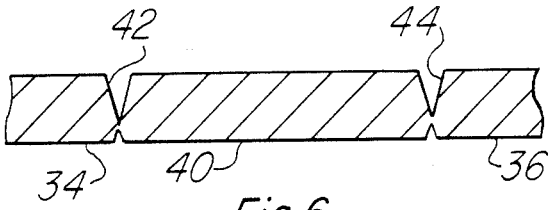
Fig.6
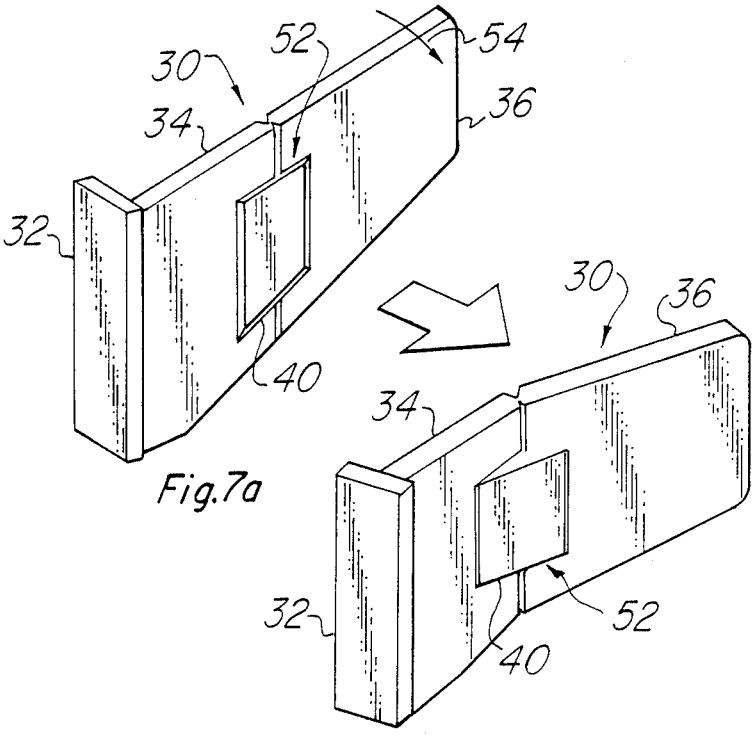
Fig.7a
Fig.7b

ARTICLE HOLDER

FIELD OF THE INVENTION

The present invention relates in general to an article holder for holding an article such as, typically, an article having an axial bore which is open at the opposite ends thereof. Particularly, the present invention relates to an article holder for holding such an article in a manner to allow the article to turn about a fixed axis. Representative examples of articles which may be held or supported by an article holder according to the present invention are paper rolls for use in printers of computers and electronic calculators. Thus, the present invention is more particularly concerned with a paper-roll holder for use in such a printing appliance.

BACKGROUND OF THE INVENTION

There are known various types of paper-roll holders for use in printers of computers and electronic calculators. These prior-art paper-roll holders use a spring loaded paper roll retaining assembly, arm members of spring steel to have a paper roll elastically held therebetween, rigid movable arm members enabling a paper roll to move to and from a position disengageable from the holder, or a spindle journalled in bearings to have a paper roll removably supported thereon throughout the length of the roll. Problems are encountered in any of these prior-art paper-roll holders in that skilled techniques and meticulous steps are required for loading a paper roll on the paper-roll holder and that the spring incorporated in the holder may become unable to support the paper roll when the elasticity of the spring is deteriorated after use of the holder. A problem is further encountered in that the holder is composed of a relatively large number of component members and is not only costly but also undesirable for production on a quantity basis. The present invention contemplates resolution of all these problems which have thus far been inherent in known paper-roll holders of the described types.

SUMMARY OF THE INVENTION

An article holder according to the present invention is characterized by a totally unitary construction forming a living hinge structure. The living hinge structure is provided by integral sheet portions and sections coupled together across hinge lines to provide ease of mounting an article on and removing the article from the holder and to permit significant reduction in the number of the component members and elements and accordingly the production cost of the article holder.

In accordance with the present invention, there is provided an article holder for holding an article, comprising (a) a base section, (b) a flap section hingedly connected to the base section across split first hinge lines which extend laterally of the unitary member, (c) an intermediate joint section intervening between the base section and flap section and having a portion extending into the base section and a portion extending into the flap section, the joint section being defined by a second hinge line intervening between the base and joint sections, a third hinge line intervening between the flap and joint sections, and a pair of cut lines extending between the second and third hinge lines, d) the split first hinge lines being substantially aligned with each other across the intermediate joint section, the second and third hinge lines extending substantially in parallel with the first hinge lines, and e) a generally cylindrical spool portion axially extending from one side face of the flap section.

BRIEF DESCRIPTION OF THE DRAWINGS

The drawbacks of prior-art article holders and the features and avantages of an article holder according to the present invention will be more clearly understood from the following description taken in conjunction with the accompanying drawings in which like reference numerals designate similar or corresponding members, portions and elements and in which:

FIG. 5 is a fragmentary sectional view taken along line V—V in FIG. 4;

FIG. 6 is a fragmentary sectional view taken along line VI—VI in FIG. 4;

FIG. 7A is a perspective view showing the article holder of FIGS. 3 and 4 in a condition having all of the hingedly connected sections of the holder maintained flush with one another with or without an article such as a paper roll retained by the holder;

FIG. 7B is a view similar to FIG. 7A but shows the article holder of FIGS. 3 and 4 in a condition ready to have an article such as a paper roll fitted to or removed from the article holder;

DESCRIPTION OF THE PRIOR ART

Figure 1:
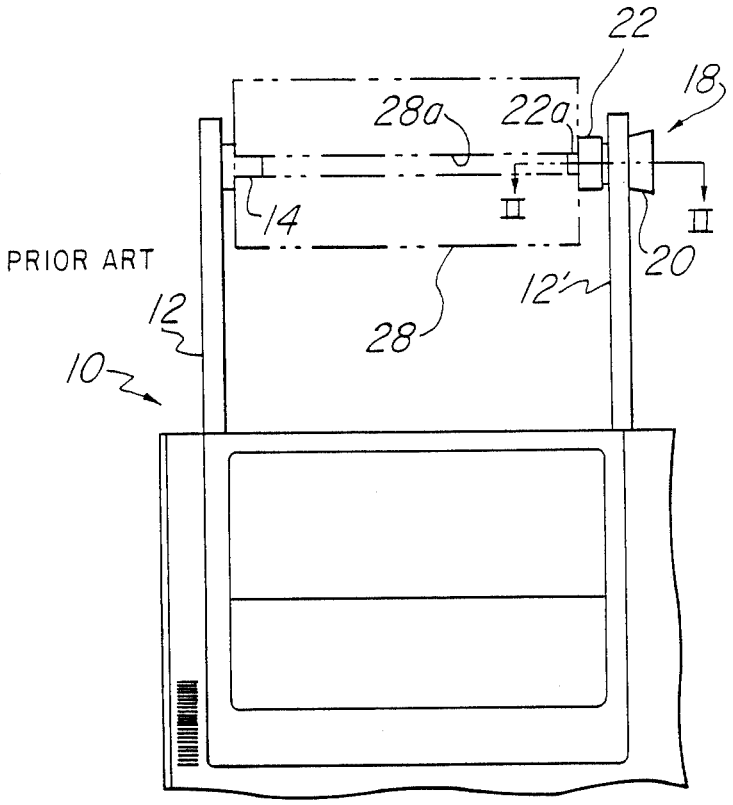
FIG. 1 is a top plan view showing the general construction of a representative example of prior-art paper holders.
Figure 2:
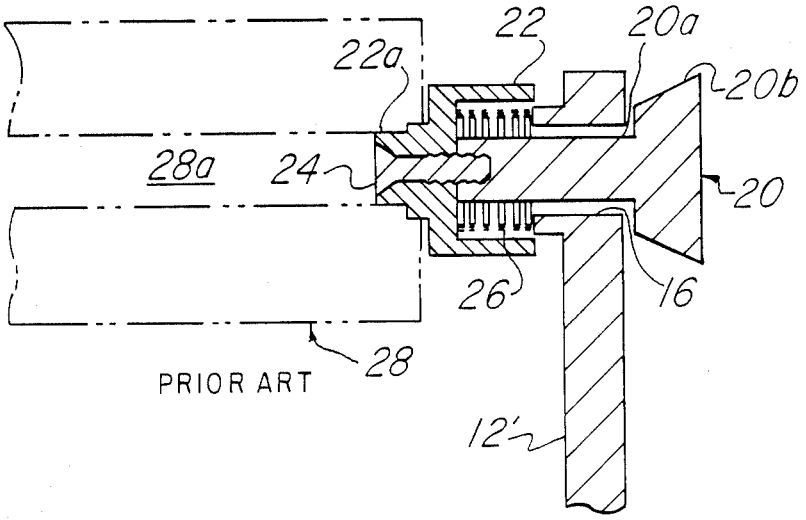
FIG. 2 is a sectional view showing strategic portions of the paper-roll holder illustrated in FIG. 1, the section being taken on a plane indicated by lines II—II in FIG. 1.

In FIG. 1 is shown a typical representative example of a prior-art paper-roll holder incorporated in a printer of a computer or a calculator. The paper-roll holder includes a support structure 10 having a pair of arm members 12 and 12' which are spaced in parallel from each other. One arm member 12 has a spindle 14 projecting from a leading end portion of the arm member 12 toward the other arm member 12'. As will be better seen from FIG. 2, the other arm member 12' has a circular aperture 16 formed in a leading end portion of the arm member 12' and has mounted on the leading end portion an adjustable paper roll retaining assembly 18.

The adjustable paper roll retaining assembly 18 of the prior-art paper-roll holder includes a knob 20 consisting of a stem portion and a frusto-conical head portion extending from the stem portion. The stem portion extends through the aperture 16 in the arm member 12' and the frusto-conical head portion projects outwardly from the aperture 16 in the arm member 12'. The stem portion of the knob 20 is axially movable through the aperture 16 in the arm member 12' and is securely connected at its leading end to a hollow, generally cup-shaped pressing member 22. The pressing member 22 has a concavity open toward the arm member 12' and is fastened to the stem portion of the knob 20 by means of a screw 24. The stem portion of the knob 20 is in part surrounded by a helical compression spring 26 which is seated at one end on the arm member 12' and at the other on an end wall portion of the pressing member 22 to urge the pressing member 22 axially away from the arm member 12'.

The pressing member 22 has an axial protrusion **22*a* aligned with the spindle 14 on the leading end portion of the arm portion 12 as will be seen from FIG. 1. A paper roll 28 having an axial bore 28*a* can thus be supported by the prior art paper-roll holder with the spindle 14 received in one axial end portion of the bore 28*a* and the axial protrusion 22*a* of the pressing member 22 received in the other axial end portion of the bore 28*a* as shown. Thus, the paper roll retaining assembly 18 has its pressing member 22 held in pressing contact with one end face of the paper roll 28 by the force of the spring 26 and holds the roll in place while allowing the roll to turn about its center axis which extends between the spindle 14 and the axial protrusion 22*a* of the pressing member 22. To have the paper roll 28 removed from the holder, the head portion of the knob 20 is manually pulled away from outer face of the arm member 12' to move the pressing member 22 toward the inner face of the arm member 12'. The pressing member 22 is moved until the protrusion 22*a* of the pressing member 22 is axially moved out of the bore 28*a* in the paper roll 28 against the force of the spring 26 so that the roll 28 is disengaged from the pressing member 22**.

In order that the paper-roll holder thus constructed be loaded with a fresh paper roll, the user will first fit the roll to the spindle 14 on the arm member 12 through the axial bore **28*a* in the roll 28. While holding the roll 28 by one hand, the user then pulls the knob 20 by the fingers of the other hand as far as the pressing member 20 will come into contact with the inner face of the arm member 12'. After it has been confirmed that the protrusion 22*a* of the pressing member 22 is aligned with the axial bore 28*a* in the roll 28, the user releases the knob 20 from the fingers to permit the protrusion 22*a* of the pressing member 22 to axially move into the bore 28*a* in the paper roll 28. Thus, fairly skilled techniques and meticulous steps are required for loading a fresh paper roll on the paper-roll holder especially in holding the roll in a manner to maintain alignment between the pressing member 22 and the axial bore of the roll and manipulating the knob 20 for movement in opposite directions. In addition, the use of the compression spring 26 will result in inability of the holder to support the paper roll when the elasticity of the spring is degraded after repeated application and release of stresses to and from the spring. Another problem is that the paper roll retaining assembly 18** per se of the holder is composed of a disproportionately large number of component members and is for this reason not only costly but also undesirable for production on a quantity basis.

Paper-roll holders of other designs and types are also commercially available. One of such holders uses arm members of spring steel adapted to have a paper roll elastically held between the arm members or rigid arm members one of which is movable toward and away from the other to allow a paper roll to move to and from a position disengageable from the holder. Another known paper-roll holder uses an elongated spindle which is journalled at opposite ends in bearings to have a paper roll supported on the spindle throughout the length of the roll. All of these prior-art paper-roll holders more or less have drawbacks essentially similar to those inherent in the paper-roll holder of the type described with reference to FIGS. 1 and 2. As noted previously, the present invention aims at provision of an improved article holder which is free from such drawbacks.

DESCRIPTION OF THE PREFERRED EMBODIMENTS

Figure 3:
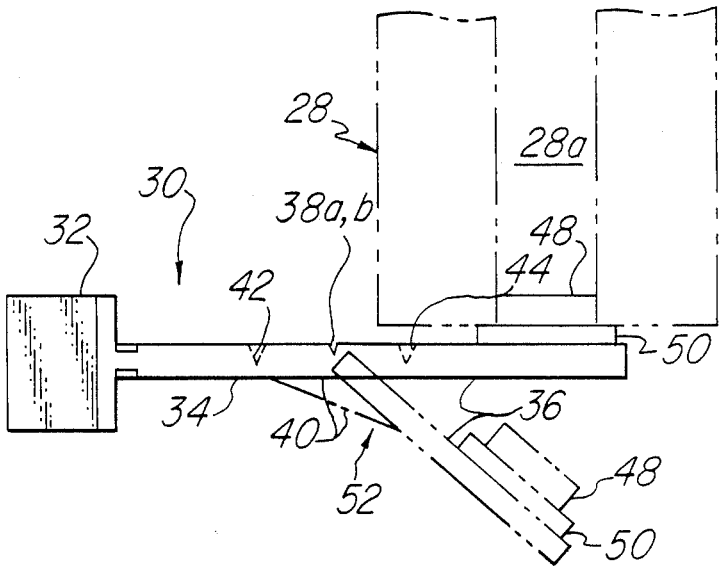
FIG. 3 is a top end view showing a first preferred embodiment of an article holder according to the present invention.
Figure 4:
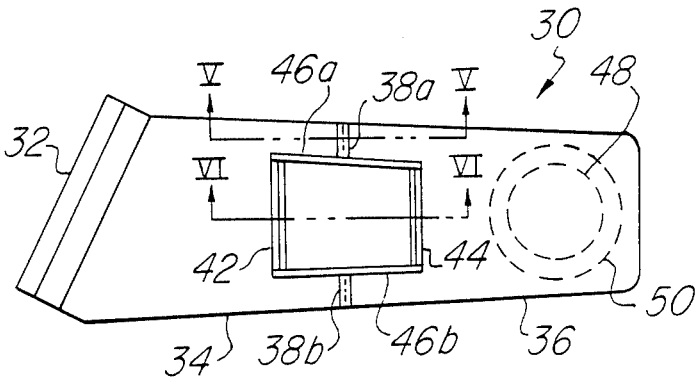
FIG. 4 is a side elevation view of the article holder shown in FIG. 3.

In FIGS. 3 and 4 is shown a first preferred embodiment of an article holder according to the present invention. The article holder herein shown is to be used as a paper-roll holder and consists of a molded unitary member 30 of any thermoplastic polymer such as, for example, polypropyrene. The unitary member 30 has inner and outer faces which are shown as upper and lower faces, respectively, of the member 30 in FIG. 3. The unitary member 30 thus forming the paper-roll holder comprises a bracket portion 32 to be fixedly attached to or detachably plugged into, for example, any structural or socket member of a printing apparatus of a computer or a calculator (not shown). The unitary member 30 further comprises a base section 34 extending from the bracket portion 32 and a flap section 36 extending from the base section 34 away from the bracket portion 32 across split first hinge lines **38*a* and 38*b* which extend laterally of the unitary member 30. Between the base section 32 and flap section 34 is provided an intermediate joint section 40 which has one half portion extending into the base section 34 and the other half portion extending into the flap section 36. The intermediate joint section 40 bridges the base and flap sections 34 and 36 through a second hinge line 42 intervening between the base and joint sections 34 and 40 and a third hinge line 44 intervening between the flap and joint sections 36 and 40. The split first hinge lines 38*a* and 38*b* extend and are aligned with each other across the intermediate joint section 40 and the second and third hinge lines 42 and 44 also extend laterally of the unitary member 30 and accordingly in parallel with the first hinge lines 38*a* and 38*b* as shown. The intermediate joint section 40 is defined by these second and third hinge lines 42 and 44 and further by a pair of parallel cut lines 46*a* and 46*b* which extend at right angles to the hinge lines 38*a*, 38*b*, 42 and 44. One of the cut lines 46*a* and 46*b* extends between one extreme end of the second hinge line 42 and one extreme end of the third hinge line 44, and the other of the cut lines extends between the other extreme ends of the hinge lines 42 and 44. One of the split first hinge lines 38*a* and 38*b* terminates at the cut line 46*a* and the other of the hinge lines 38*a* and 38*b* terminates at the cut line 46*b* to enable the flap section 36 to move with respect to the base section 34**.

The paper-roll holder embodying the present invention further comprises a cylindrical spindle or spool portion 48 axially extending from the inner face of the flap section 36. As indicated by phantom lines in FIG. 3, the spool portion 48 is to be snugly received in the axial bore **28*a* in a paper roll 28 to be supported by the paper-roll holder under consideration and has an outside diameter substantially equal to the diameter of the bore 28***a*. In order to significantly reduce the friction between the end face of the paper roll 28 and the unitary member 30, the spool portion 48 may project through an annular flange portion 50 from the inner face of the flap section 36.

In the paper-roll holder thus configured in accordance with the present invention, the flap section 36 is hingedly connected to the base section 34 through the split first hinge lines 38*a* and 38*b* and is pivotally movable with respect to the base section 34 about an axis defined by these hinge lines 38*a* and 38*b*. Likewise, the intermediate joint section 40 is hingedly connected to the base section 34 through the second hinge line 42 and is pivotally movable with respect to the base section 34 about an axis defined by the second hinge line 42. The joint section 40 is further hingedly connected to the flap section 36 through the third hinge line 44 so that the flap section 36 is pivotally movable not only with respect to the base section 34 about the axis defined by the hinge lines 38*a* and 38*b* but also with respect to the joint section 40 about an axis defined by the third hinge line 44. Each of the hinge lines 38*a*, 38*b*, 42 and 44 thus provided in the unitary member 30 of the paper-roll holder thus configured is typically implemented by a thinned narrow strip portion as will be better seen from FIGS. 5 and 6. In this instance, it is preferable that each of the second and third hinge lines 42 and 44 be deeper from the outer face of the unitary member 30 than the split first hinge lines 38*a* and 38*b* as will be seen from comparison between FIGS. 5 and 6 to enable the intermediate joint section 40 to pivotally move smoothly with respect to both of the base and flap sections 34 and 36. The combination of the hinge lines 38*a*, 38*b*, 42 and 44 provides a hinge structure 52 known as "living hinge" in the art. The unitary member 30 having such a living hinge structure is constructed preferably of polypropyrene for the particularly excellent hinge effect achievable of the material.

The individual sections 34, 36 and 40 hingedly connected together of the paper-roll holder as hereinbefore described are normally flattened or flush with one another as shown in FIG. 7A. When an external or manipulative effort is applied to the flap section 36 of the holder in such a condition, the flap section 36 is forced to turn outwardly about the pivot axis defined by the split first hinge lines 38*a* and 38*b* between the base and flap sections 34 and 36. With the bracket portion 32 of the holder held in place, the flap section 36 is caused to turn with respect to the base section 34 as indicated by arrow 54 in FIG. 7A. Concurrently as the flap section 36 is being thus pivotally moved about the the axis defined by the hinge lines 38*a* and 38*b*, the intermediate joint section 40 is also caused to turn outwardly with respect to the base section 34 about the pivot axis defined by the second hinge line 42 between the base and joint sections 34 and 40. Such pivotal movement of the joint section 40 with respect to the base section 34 is accompanied by pivotal movement of the flap section 36 with respect to the joint section 40 about the pivot axis defined by the third hinge line 44 between the flap and joint sections 36 and 40. Thus, the intermediate joint section 40 bridging the base and flap sections 34 and 36 finally forms a ramp slanting outwardly from the base section 34 to the flap section 36 which is inclined also outwardly from the base section 34, as shown in FIG. 7B and further indicated by phantom lines in FIG. 3. It may be noted that flap and joint sections 36 and 40 are moved into the final positions with respect to the base section 34 by snap actions produced when the flap and joint sections 36 and 40 are inclined to the base section 34 at angles which are dictated by the geometry of the living hinge structure 52 provided by the hinge lines 38*a*, 38*b*, 42 and 44. The paper-roll holder deformed into the configuration shown in FIG. 7B is now ready to have a paper roll removed from the holder or a fresh paper roll fitted to the holder after the paper roll which has been retained by the holder is removed therefrom.

The paper-roll holder proposed by the present invenion may be used in combination with another such paper-roll holder but is used typically in combination with a stationary spindle which may be arranged similarly to the spindle 14 used in the prior-art holder arrangement shown in FIG. 1. In this instance, the paper-roll holder retaining a paper roll 28 has its spool portion 48 snugly received in the axial bore 28*a* in the paper roll 28 at one end of the roll as indicated by phantom lines in FIG. 3 with the paper roll 28 further retained by means of the stationary spindle (not shown) which projects into the bore 28*a* at the opposite end of the roll 28. The paper roll 28 thus retained by the paper-roll holder can be readily removed from the paper-roll holder simply by moving the flap section 36 from the position shown in FIG. 7A to the position shown in FIG. 7B or indicated by the phantom lines in FIG. 3. For loading a fresh paper roll 28 on the paper-roll holder thereafter, the user fits the fresh roll 28 to the stationary spindle through the axial bore 28*a* in the roll 28 with the flap section 36 maintained in the position shown in FIG. 7B. The position of the paper roll 28 is then adjusted correctly with respect to the spool portion 48 of the paper-roll holder with the roll 28 held by one hand. After it has been confirmed that the paper roll 28 is correctly positioned with respect to the paper-roll holder, the user has only to lightly depress the flap section 36 toward the end face of the roll 28 by a finger of the other hand. The flap section 36 and accordingly the joint section 40 are now turned back by snap actions to their initial positions flush with the base section 34 as shown in FIG. 7A so that the spool portion 48 of the paper-roll holder is properly allowed into the axial bore 28*a* in the roll 28. The fresh paper roll 28 can thus be fitted to the paper-roll holder without having recourse to any skilled techniques and meticulous steps.

Figure 8:
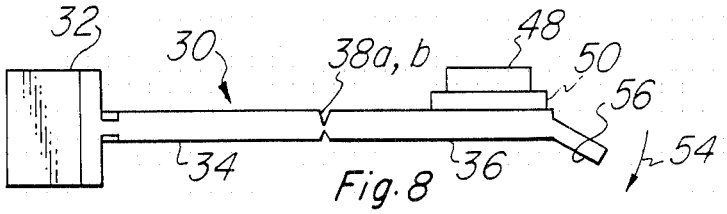
FIG. 8 is a top end view showing a second preferred embodiment of an article holder according to the present invention.

FIG. 8 shows a second preferred embodiment of an article holder according to the present invention. The article holder herein shown is a modification of the embodiment shown in FIGS. 3 and 4 and comprises a unitary member 30 having a knob or lug portion 56 in addition to a bracket portion 32, base and flap sections 34 and 36, an intermediate joint section 40 and a spool portion 48. These portions 32 and 48 and sections 34, 36 and 40 of the unitary member 30 forming the second preferred embodiment of the present invention are all similar to their respective counterparts of the first preferred embodiment. In the embodiment shown in FIG. 8, the knob or lug portion 56 protrudes from the leading end of the flap section 36 opposite to the base section 34 and is in part spaced apart outwardly from the plane defining the outer face of the section 36. It will be apparent that such a knob or lug portion 56 is useful for facilitating the user to apply a force to the flap section 36 in turning the flap section 36 in the direction of the arrow 54. The knob or lug portion 56 further adds to the torque to be applied to the flap section for turning the flap section 36 about the pivot axis defined by the split first hinge lines 38*a* and 38*b* and will therefore contribute to reducing the manual effort to be applied to the flap section 36.

Figure 9:
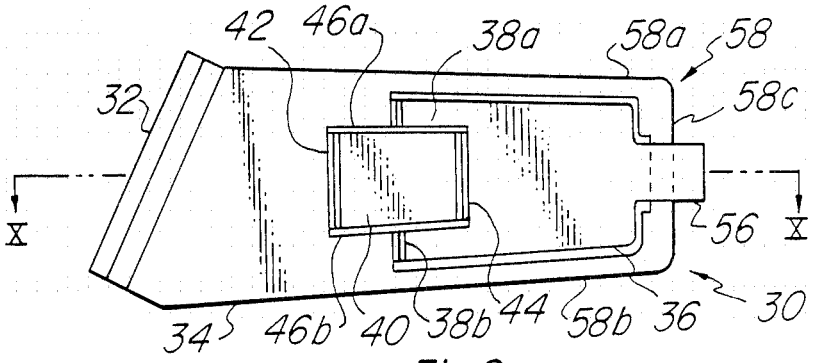
FIG. 9 is a side elevation view showing a third preferred embodiment of an article holder according to the present invention.
Figure 10:
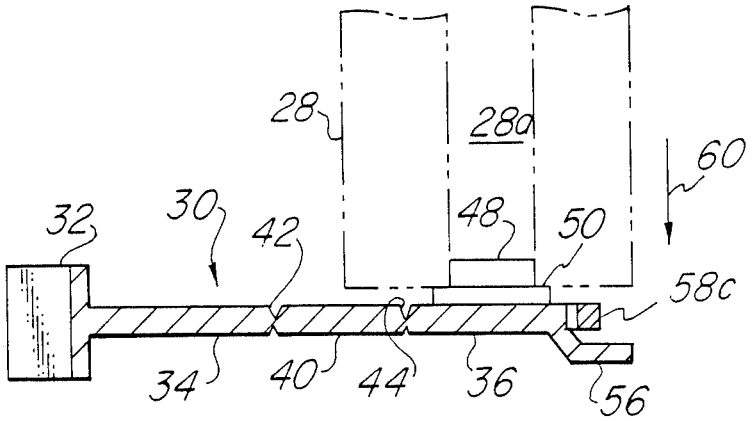
FIG. 10 is a sectional view taken on a plane indicated by lines X—X in FIG. 9.

FIGS. 9 and 10 show a third preferred embodiment of an article holder according to the present invention. The article holder herein shown is a further modification of the embodiment shown in FIG. 8 and is characterized in that the unitary member 30 further has a frame portion 58 in addition to the component portions 32, 48 and 56 and sections 34, 36 and 40 of the paper-roll holder shown in FIG. 8. The frame portion 58 is formed integrally with the base section 34 and circumscribes the flap section 36 in a manner to allow the section 36 to be pivotally movable with respect to the frame portion 58. Such a frame portion 58 comprises a pair of parallel longitudinal frame portions 58*a* and 58*b* extending along the longitudinal edges, respectively, of the flap section 36 from the base section 34. The frame portion 58 further comprises a lateral frame portion 58*c* extending perpendicularly between the leading ends of the frame portions 58*a* and 58*b* along the lateral edge of the section 36 opposite to the base section 34 as shown. As will be clearly seen from FIG. 10, the lateral frame portion 58*c* is in part overridden by the knob or lug portion 56. The frame portion 58 thus provided around the flap section 36 serves as reinforcement and guard means for the paper-roll holder to protect the strategic portions and sections of the holder by absorbing the energy of a mechanical impact which may be imparted to the unitary member 30 or isolating the flap section 36 and living thinge structure 52 from such an impact. It may happen that the paper roll 28 fitted to the paper-roll holder is forced to axially move in a direction to press upon the flap section 36 as indicated by arrow 60. Absent the frame portion 58 around the flap section 36, the paper roll 28 thus forced toward the flap section 36 would cause the section 36 to turn with respect to the base section 34 in the direction of the arrow 54. When this occurs during use of the paper-roll holder, the spool portion 48 of the paper-roll holder would be in the worst case dislodged from the paper roll 28, which would thus be allowed to fall from the holder by its own weight. With the provision of the frame portion 58 around the flap section 36, the paper roll 28 axially moved in the direction of the arrow 60 is brought into abutment with the frame portion 58 and is prevented from being moved beyond the plane defined by the inner face of the frame portion 58. The flap section 36 could not therefore be turned in the direction of the arrow 54 and enables the paper roll 28 to stay in situ on the paper-roll holder.

While a few preferred embodiments of an article holder according to the present invention have thus far been described and shown, it should be borne in mind that such embodiments are merely for illustrative purposes and may therefore be modified in numerous manners if desired. Particularly, the shown shapes of the individual component portions and sections of the unitary member 30 forming each of the described embodiments are among various possible examples of the shapes of the portions and sections of an article holder according to the present invention and may be modified arbitrarily. While, furthermore, it has been assumed that a paper-roll holder embodying the present invention is to be used in combination with a spindle which may be arranged similarly to the spindle 14 in the arrangement shown in FIG. 1, two of such a paper-roll holder may be used in combination, one for supporting a paper roll at one end of the roll and the other for supporting the roll at the other end of the roll. If desired, furthermore, an article holder according to the present invention may be provided in combination with a suitable form of biasing means such as a spring arranged to facilitate or enhance the snap actions of the living hinge structure 52 of the holder.

Figure 11:
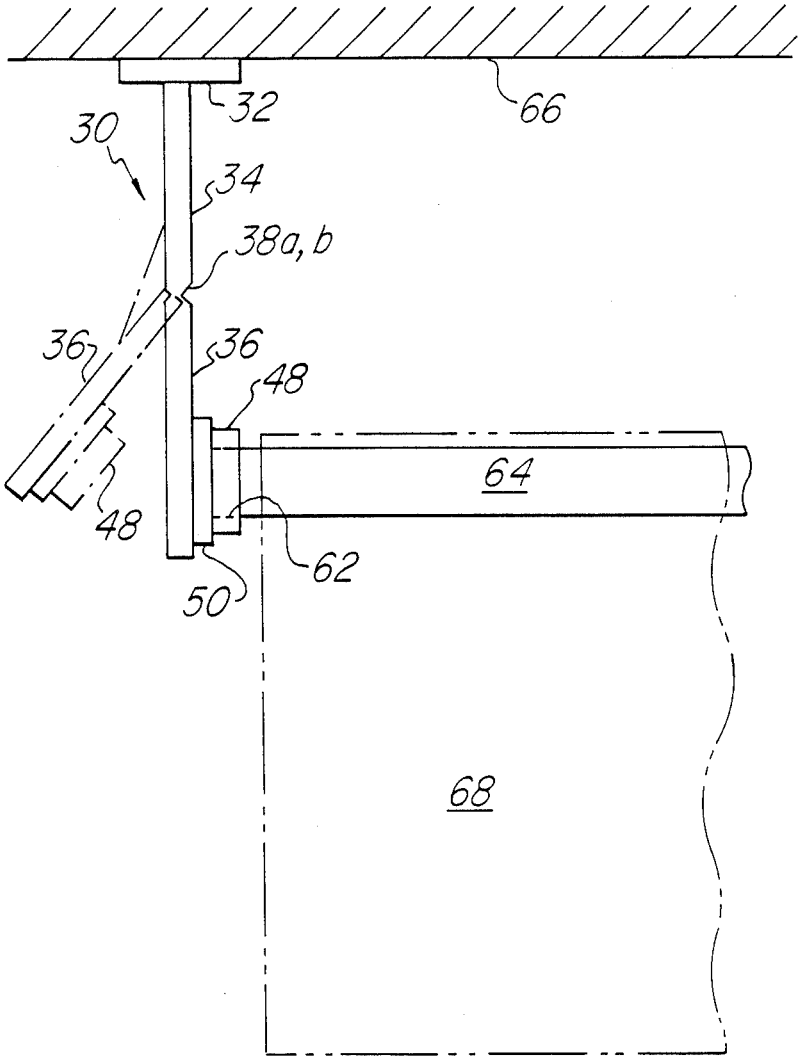
FIG. 11 is a top plan view showing part of the arrangement in which an article holder embodying the present invention is used to provide a towel rail assembly.

The present invention has been assumed to be applied to paper-roll holders for the printers of computers and calculators. An article holder according to the present invention will however find various other practical applications for supporting articles which may have bores or may have no bores. For supporting an article with no axial bore, the spool portion 48 of the paper-roll holder is formed to be hollow with, for example, a cylindrical or otherwise shaped concavity formed therein and a suitable member such as a bar or rod is detachably fitted at one end to the spool portion 48 through such a concavity. FIG. 11 shows an example of the arrangement in which the paper-roll holder described with reference to FIGS. 3 and 4 is used in such a manner for providing a towel rail. The spool portion 48 of the paper-roll holder herein shown is formed with a cylindrical concavity 62 and has a rail rod 64 fitted at one end into the concavity 62. Two of the paper-roll holder shown are used and spaced apart a certain distance from each other and are fixedly attached to a wall 66 with the rail rod 64 extending between the respective spool portions 48 of the two holders. The combination of these holders may be used for hanging, for example, a towel 68 from the rail rod 64 while allowing the towel 68 to be removed either from the rod 64 or, together with the rod 64, from the holders with the flap section 36 of at least one holder turned outwardly as indicated by phantom lines. Other advantageous applications of an article holder according to the present invention include film reels for photographic and movie cameras and image projectors.

As will have been appreciated from the foregoing description, an article holder according to the present invention is advantageous firstly in that an article such as typically a paper roll can be fitted to the holder without having recourse to any skilled techniques and meticulous steps. Since, in addition, no extra biasing means such as a spring is provided on the unitary member forming the holder, the holer is enabled to operate properly and in a stable state even after articles are exchanged repeatedly during use of the holder. Furthermore, a paper-roll holder according to the present invention is composed of a single unitary member and can for this reason be manufactured economically on a quantity production basis.

What is claimed is:

1. An apparatus comprising:

(a) a unitary member including a frame portion and a flap portion, said frame portion circumscribing said flap portion, (b) said flap portion hingedly connected to said frame portion across split first hinged lines which extend laterally of the unitary member, (c) an intermediate joint section intervening between the frame portion and the flap portion and having a portion extending into the frame portion and a portion extending into the flap portion, the joint section being defined by a second hinge line intervening between the frame portion and joint section, a third hinge line intervening between the flap portion and joint section, and a pair of cut lines extending between the second and third hinge lines.

2. The apparatus according to claim 1 wherein said first hinged lines have a narrow portion intermediate the sides of said flap or frame portions.

3. The apparatus according to claim 1 wherein said second and third hinge lines extend substantially parallel with said first hinge lines.

4. The apparatus according to claim 1 wherein said frame portion includes a base portion and a pair of longitudinal frame portions extending along the longitudinal edges respectively of said flap portion from said base portion and a lateral frame portion extending substantially at right angles between said longitudinal frame portions along the lateral edge of the flap portion opposite to said base portion.

5. The apparatus according to claim 1 further including a generally cylindrical spool portion attached to one side of said flap portion.

6. The apparatus according to claim 1 further including a lug portion protruding from said flap portion.

7. The article according to claim 6 wherein said lug portion extends from said flap portion in the direction so as to be spaced apart from the plane defining one face of the flap portion and extending over at least a part of one face of said frame portion.

* * * * *